United States Patent [19]

Golbeck et al.

[11] 4,032,730

[45] June 28, 1977

[54] ROTARY SWITCH HAVING A STATOR WITH A CONDUCTIVE MATRIX

[75] Inventors: Bernard J. Golbeck, Crystal Lake; Raymond F. Lewandowski, Mount Prospect; Maurice E. Kennedy, Crystal Lake, all of Ill.

[73] Assignee: Oak Industries Inc., Crystal Lake, Ill.

[22] Filed: Mar. 29, 1976

[21] Appl. No.: 671,510

[52] U.S. Cl. ..... 200/11 DA; 200/11 A; 200/14; 200/291; 200/292; 200/307

[51] Int. Cl.$^2$ ..... H01H 19/08

[58] Field of Search ..... 200/11 R, 11 A, 11 D, 200/11 DA, 11 TW, 14, 15, 291, 292, 293, 294, 295, 296, 307

[56] References Cited

UNITED STATES PATENTS

| | | | |
|---|---|---|---|
| 1,205,549 | 11/1916 | Kruesheld | 200/11 A |
| 3,248,488 | 4/1966 | Stephan | 200/11 D |
| 3,525,827 | 8/1970 | Allison | 200/295 X |
| 3,567,894 | 3/1971 | Spreitzer | 200/307 |
| 3,588,392 | 6/1971 | Cartwright | 200/11 A |
| 3,668,338 | 6/1972 | O'Malley | 200/11 A |

FOREIGN PATENTS OR APPLICATIONS

| | | | |
|---|---|---|---|
| 2,006,280 | 12/1969 | France | 200/11 A |
| 2,152,128 | 4/1973 | Germany | 200/11 DA |

*Primary Examiner*—James R. Scott
*Attorney, Agent, or Firm*—Kinzer, Plyer, Dorn & McEachran

[57] ABSTRACT

A rotary switch includes a stator, rotor and shaft for the rotor. The stator has a complex conductive matrix formed of criss-crossing conductive sections integrally joined together and integral with a central annular ring. The annular ring in turn has radially inwardly-extending switch sections. There is a non-conductive support member for the matrix, with the matrix and support member having respective and cooperating openings and projections for positioning the matrix on the support member. The rotor has a plurality of pockets with contact members positioned in at least one of the pockets and arranged for electrical contact with portions of said matrix.

20 Claims, 11 Drawing Figures fig.1.
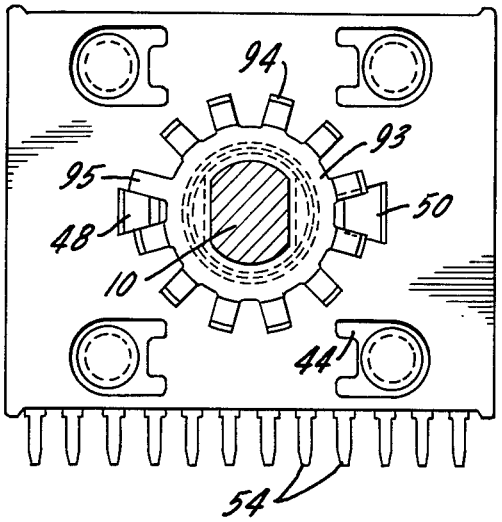
fig.2.
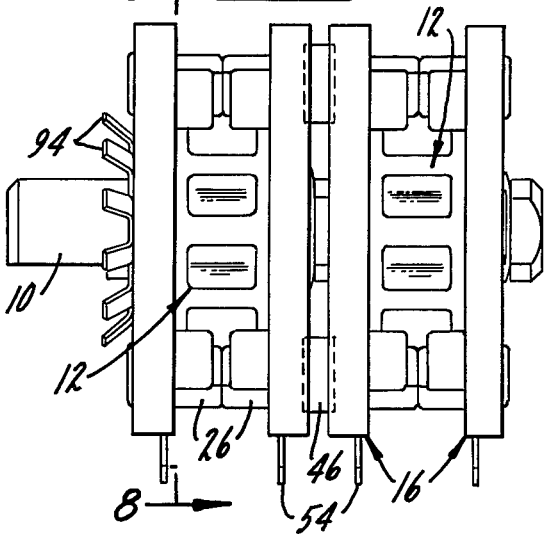
fig.3.
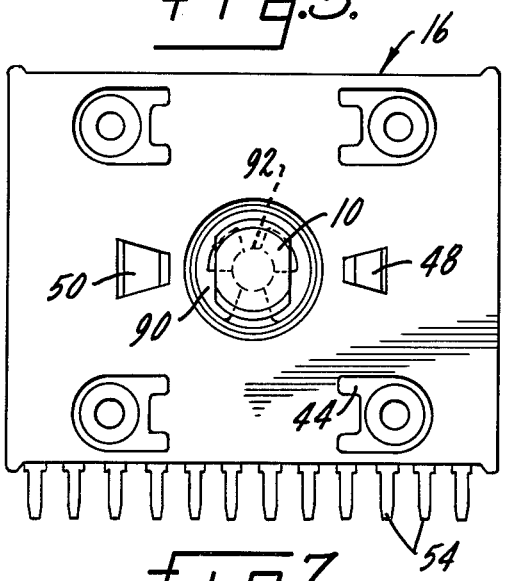
fig.4.
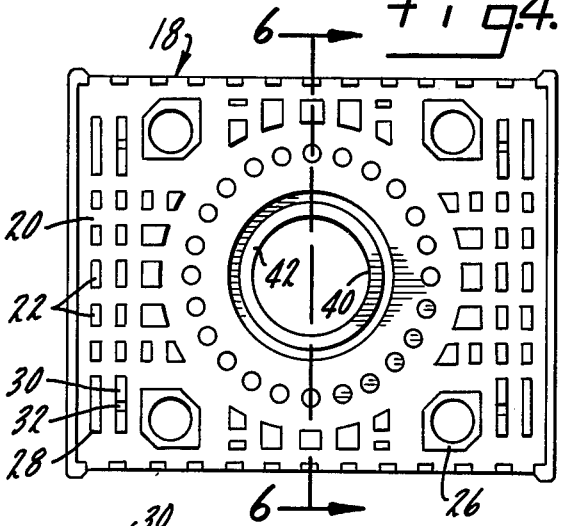
fig.5.
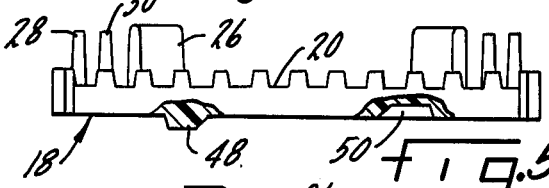
fig.7.
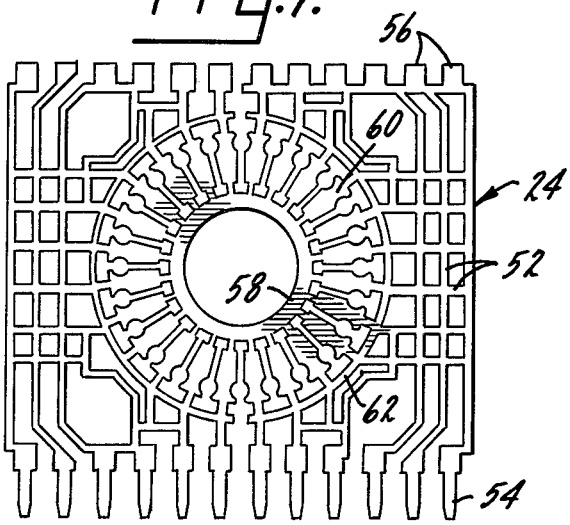
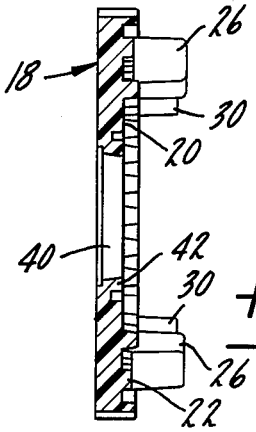
fig.6.

ROTARY SWITCH HAVING A STATOR WITH A CONDUCTIVE MATRIX

SUMMARY OF THE INVENTION

The present invention relates to rotary switches of the type having a complex electrical matrix positioned in a non-conductive support member as the stator and a rotor having contacts disposed adjacent to the matrix.

One purpose of the invention is a switch of the type described in which the stator has a complex conductive matrix positioned within a non-conductive support member with the matrix and support member having respective and cooperating openings and projections for positioning the matrix relative to the support member.

Another purpose is a structure of the type described in which the rotor encloses all of the switching contact areas.

Another purpose is a structure of the type described in which the rotor outer cylindrical wall carries integral detents.

Another purpose is a structure of the type described having contacts with bifurcated arms.

Another purpose is a rotary switch of the type described in which a rotor has a series of contact pockets, the pockets being positioned variable distances from the rotor axis to provide contact tracking along different radii.

Another purpose is a rotary switch of the type described in which the rotor and stator have cooperating hubs providing bearing surfaces.

Another purpose is a rotor of the type described formed of a resilient material holding the rotor shaft in a press fit, thus eliminating backlash between the shaft and rotor.

Another purpose is a stator of the type described in which the support member is formed of a thermoplastic material so that the matrix may be attached to the support member by heat or sonic welding.

Another purpose is a rotary switch of the type described in which switch sections may be stacked, one upon the other.

Another purpose is a rotary switch of the type described having an integral stop on the stator and a washer on the switch shaft which is formed and adapted to cooperate with the stop.

Another purpose is a rotary switch having a stator and rotor of the type described in which each stator section has integral spacing posts.

Another purpose is a stator for use in a switch construction providing for stacking of several such sections and with recesses in the stator to accomodate spacers between switch sections.

Another purpose is a rotary switch in which the stator mounts a conductive matrix formed of criss-crossing integral stator sections which may be severed to provide specified circuit configurations.

Another purpose is a structure of the type described in which the stator matrix sections may be severed by mechanical or chemical means.

Other purposes will appear in the ensuing specification, drawings and claims.

BRIEF DESCRIPTION OF THE DRAWINGS

The invention is illustrated diagrammatically in the following drawings wherein:

FIG. 1 is a front view of a switch of the type described,

FIG. 2 is a side view of the switch with switch sections stacked together,

FIG. 3 is a back view of the switch,

FIG. 4 is a plan view of the stator with the matrix removed,

FIG. 5 is a bottom view of the stator of FIG. 4, with portions broken away,

FIG. 6 is a section along plane 6—6 of FIG. 4,

FIG. 7 is a plan view of the conductive matrix,

DESCRIPTION OF THE PREFERRED EMBODIMENT

Figure 9:
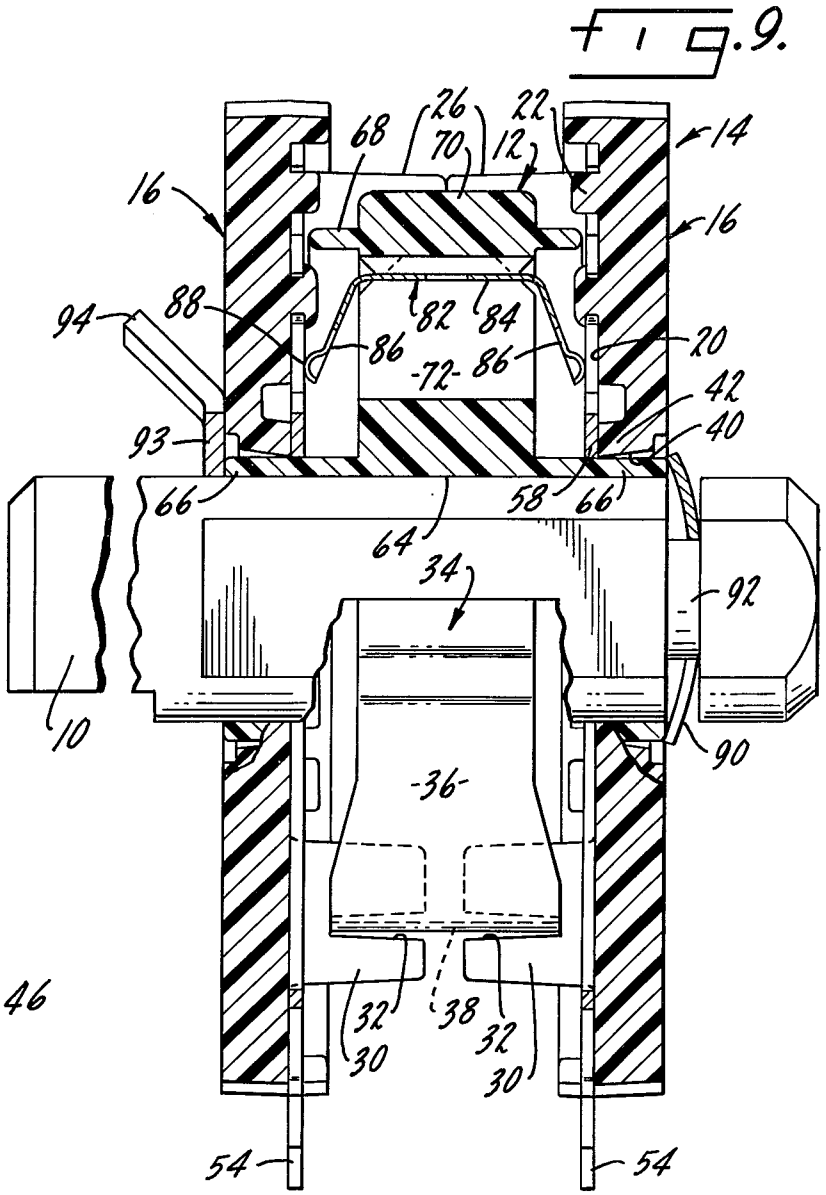
FIG. 9 is a section along plane 9—9 of FIG. 8.
Figure 10:
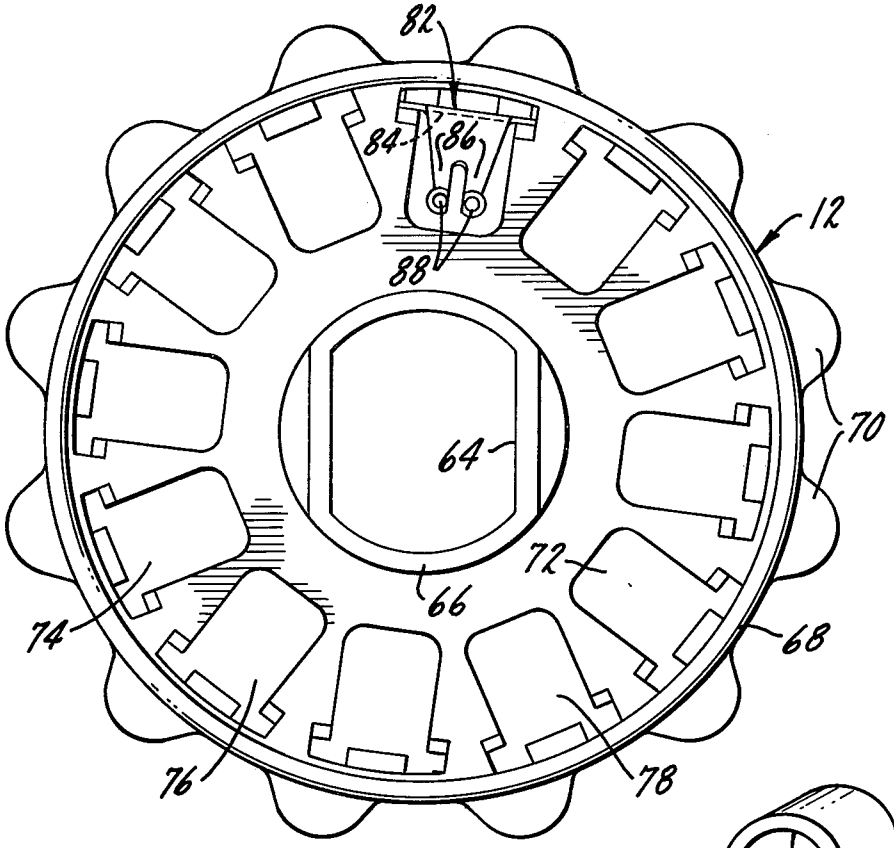
FIG. 10 is a plan view of the rotor.

The switch basically includes a rotor, a stator, and a shaft. Looking particularly at FIG. 9, the shaft is indicated at 10, the rotor at 12 and the stator is indicated generally at 14. Stator 14 is made up of two generally identical stator sections 16 which are shown in detail in FIGS. 4, 5, 6 and 7. The rotor is shown in detail in FIG. 10.

Figure 8:
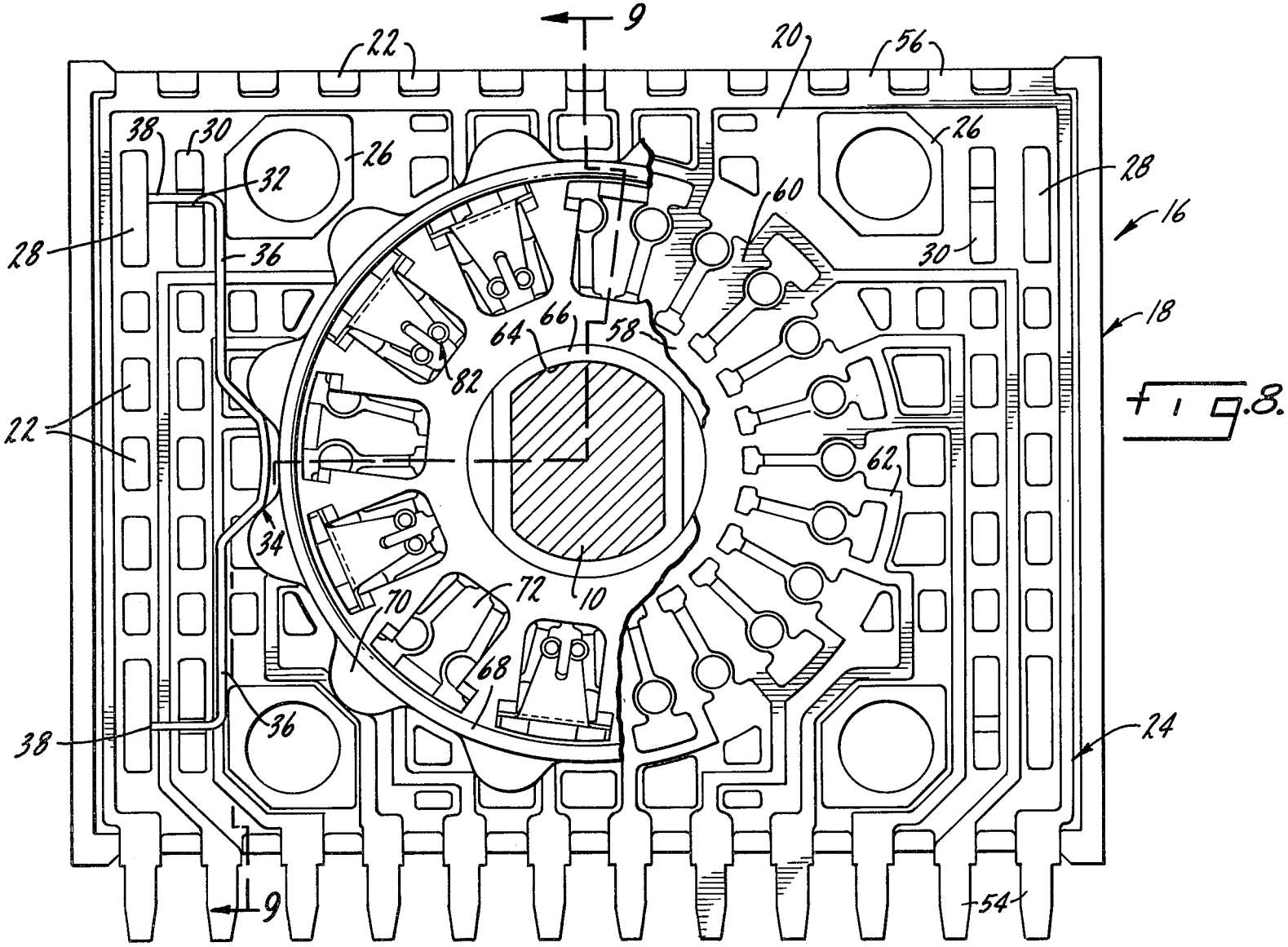
FIG. 8 is a section along plane 7—7 of FIG. 2, with parts broken away.

Looking first at the stator, each section 16 includes a non-conductive support member or housing portion 18 which may conveniently be made of a suitable plastic material. Support member 18 has a base 20 and a series of spaced, variably positioned, upwardly-extending projections 22, shown in plan in FIG. 4, which projections are used to locate a conductive matrix 24 shown in detail in FIG. 7. FIG. 8 shows conductive matrix 24 positioned upon base 20 with projections 22 properly locating the matrix. In this connection, after assembly, since the stator may be formed of a thermoplastic material, the matrix 24 may be permanently affixed to base 20 by heat or sonic welding. Base 20 may further have four upstanding hollow posts 26 which are generally located adjacent corners of base 20 which are used to properly space the two stator sections, one from another. Note particularly FIG. 2, which shows a pair of switches mounted on a single shaft, but which clearly shows projections 26 spacing stator sections 16 in proper relationship with each other. Base 20 further has, at each corner, detent spring projections 28 and 30. Note in the plan view of FIG. 4 that projection 28 is solid, whereas, projection 30 has a groove 32. A detent spring 34, shown in FIG. 8, has a pair of laterally extending arms 36, with a flange 38 at the end of each arm. Flanges 38 will extend through grooves 32 with the end of each flange bearing against a projection 28. Thus, projections 28 and 30 are effective to hold the detent springs within the switch and disposed relative to the detent projections on the rotor.

Figure 11:
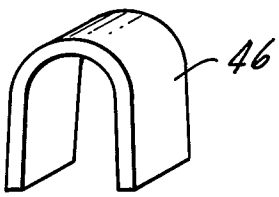
FIG. 11 is a perspective of a stacking spacer.

Base 20 has a generally central opening 40 surrounded by a cylindrical bearing member 42 which cooperates with a hub on the rotor as described hereinafter. Looking at the outside surface of base 20, there is a somewhat U-shaped indentation or recess 44 in alignment with each post 26. Such recesses are formed and adapted to receive generally U-shaped spacer members 46, illustrated in FIG. 11, for the purpose of spacing switches, as particularly illustrated in FIG. 2. The spacers may be of varying width, depending upon the desired relative position of the stacked switches. Also formed in the outside surface of base 20 is an outwardly projecting stop 48, on one side of shaft 10, and a corresponding or mating recess 50 formed on the opposite side of the shaft. Thus, there is provision for the stacked switch sections to be in contact with each other, eliminating the U-shaped spacers 46. In such an arrangement, stopes 48 will fit within projections 50.

Conductive matrix 24 may have a series of criss-crossing individual conductors 52, as particularly illustrated in FIG. 7. There are a plurality of outwardly-extending terminals 54 along one side and a similar series of terminals 56 along the opposite side. The terminals 54 and 56 may be identical or they may be different, as shown in FIG. 7. The terminals may all extend in a direction parallel with the matrix, or one set of terminals may extend at 90° to the matrix, depending upon how the switches will be used relative to a printed circuit board or other supportive member. The matrix includes a central ring 58 which is connected to each individual switching area 60. The ring may be severed or removed during assembly, or it may remain in certain specialized switching applications. Each switching sections 60 is connected to an outer ring 62 which in turn is connected to the criss cross conductive members 52. As can be seen from FIG. 8, there is the possibility of a widely varying number of connections from individual switch sections 60 to terminals 54 and 56. In most applications the matrix will be formed as shown in the drawings and certain of the conductive members52 will be mechanically or chemically severed, depending upon the precise switch pattern desired.

Rotor 12 includes a double D opening 64 which is formed by outwardly-extending hubs 66 which cooperate with bearing ring 42 on the stator sections to insure smooth and accurate rotation of the rotor relative to the stator. Rotor 12 has an outer circumferential wall 68 with a series of generally equally spaced detent projections 70 which cooperate with detent spring 34 to perform a conventional detent or indexing function. A series of spaced contact pockets 72 are formed in rotor 12. As particularly shown in FIG. 10, the pockets are circumferentially generally uniformly spaced, but may have varying radial spacing relative to the center of the rotor and outer wall 68. Note specifically pockets 74, 76 and 78, each of which are spaced different distances from the axis of rotor 12. Thus, the contacts that are positioned in the pockets may be arranged to wipe different portions of switching areas 60, thus providing more effective use, i.e. longer life for given plating thickness, of precious metal plating. Positioned within each of pockets 72 is a contact 82 which has a generally central body portion 84, as particularly shown in FIG. 9, and outwardly-extending bifurcated arms 86. The arms 86 having contact ends 88 are disposed in direct contact with switching matrix 24. As shown particularly in FIG. 9, arms 86 are of equal length, although it may be otherwise.

A bow-shaped washer 90 is positioned within a groove 92 in shaft 10 for holding the shaft to the switch structure. At the opposite end of the switch a stop washer 93 has arms 94 generally formed to extend away from the outer surface of the stator. However, one such arm 95 is bent in the opposite direction to contact and cooperate with stop 48 in a conventional manner. Although only one such stop arm 95 is shown herein, there may be two or more, depending upon the degree to which rotation of rotor 12 is to be permitted.

Of particular advantage in the switch described is the fact that the matrix 24 may be formed to a prescribed set pattern permitting subsequent severing, either mechanically or chemically, of certain conductive sections to conform to a desired switching pattern. The matrix may be heat or sonic welded to its non-conductive support member during assembly. There may be a stacking of switch sections, as shown in FIG. 2, so that a large number of generally similar switch sections may be mounted on a common shaft as is conventional in rotary switches.

The stator sections may be formed of a convenient thermoplastic material and the rotor may similarly be formed of the same material. It is advantageous to have the rotor formed of a slightly resilient material so that the drive shaft is press-fitted into the rotor center hole, thus eliminating any backlash between the shaft and rotor.

It is important to note that the outer cylindrical wall 68 of the rotor completely encloses the actual contact switching area of the matrix 24.

Whereas the preferred form of the invention has been shown and described herein, it should be realized that there may be many modifications, substitutions and alterations thereto.

The embodiments of the invention in which an exclusive property or privilege is claimed are defined as follows:

1. A rotary switch including a stator, a rotor and shaft for said rotor, said stator having a non-conductive support member and a complex conductive matrix positioned on one side thereof, said matrix and support member having respective and cooperating openings and projections for positioning said matrix on said support member, terminals on said matrix, said complex conductive matrix including a plurality of crossing, independent, conductive sections integrally joined to form a network of lines extending in different directions toward the periphery of said matrix, said rotor having a plurality of pockets with contact members positioned in at least one of said pockets and arranged for electrical contact with portions of said matrix.

2. The structure of claim 1, further characterized in that said stator includes a second non-conductive support and a second complex conductive matrix positioned on one side thereof, said second matrix and support member having respective and cooperating openings and projections for positioning said second matrix on said second support member, and terminals on said second matrix, second complex conductive matrix including a plurality of crossing, independent, conductive sections integrally joined to form a network of lines extending in different directions toward the periphery of said second matrix, said non-conductive support members and their respective matrices being positioned on opposite sides of said stator.

3. The structure of claim 2 further characterized in that said pockets extend through said rotor, with portions of rotor contacts within said pockets being positioned for contact with both of said conductive matrices.

4. The structure of claim 3 further characterized in that said rotor has an outer generally cylindrical wall forming the outer portion of each of said pockets.

5. The structure of claim 4 further characterized by and including cooperating detent means on said rotor and stator, said rotor detent means including a series of radially extending projections integral with said rotor outer wall.

6. The structure of claim 5 further characterized in that said stator detent means includes a spring member, and projections extending outwardly from one of said non-conductive support members for positioning said detent spring member.

7. The structure of claim 6 further characterized in that both of said non-conductive support members have similarly arranged and formed projections cooperating to hold said detent spring member relative to the rotor.

8. The structure of claim 1 further characterized in that said contact has a contact arm positioned for electrical contact with said conductive matrix, said contact arm being bifurcated.

9. The structure of claim 1 further characterized in that said rotor pockets are spaced varying radial distances from said rotor and shaft axis.

10. The structure of claim 1 further characterized in that said rotor has an integral hub extending within a cooperating opening in said rotor, with said hub and stator opening cooperating to form bearing surfaces for rotation of said rotor relative to said stator.

11. The structure of claim 1 further characterized in that said non-conductive support member is formed of a thermoplastic material permitting heat sealing of said conductive matrix upon said non-conductive support member.

12. The structure of claim 2 further characterized in that said non-conductive support members each have spacer posts extending toward each other for properly positioning said non-conductive support members and rotor relative to each other.

13. The structure of claim 12 further characterized by and including recesses on the side of each of said non-conductive support members opposite said spacer posts, said recesses being formed and adapted to receive spacer members for positioning stacks of rotor-stator combinations.

14. The structure of claim 1 further characterized by and including a stop formed integrally with said non-conductive support member for limiting rotation of said rotor relative thereto.

15. The structure of claim 14 further characterized in that said stop extends outwardly from the side of said non-conductive support member away from said matrix and a recess in the same side of said non-conductive support member and positioned relative to said stop whereby a similar non-conductive support member may be stacked, in a flush relationship thereto.

16. The structure of claim 14 further characterized by and including an annular stop member on said shaft having a plurality of outwardly-extending legs, at least one of said legs being arranged to contact said stator stop.

17. The structure of claim 1 further characterized in that at least a portion of said terminals are along one side of said matrix and extend outwardly from said non-conductive support member.

18. The structure of claim 1 further characterized in that said complex conductive matrix is formed and adapted to have said conductive sections severed at varying locations to form different switching networks.

19. The structure of claim 1 further characterized in that said crossing independent conductive sections are integrally joined to form a network of lines extending in both parallel and perpendicular directions, an annular ring generally centrally disposed within said matrix and integral with said parallel and perpendicular sections, a plurality of radially inwardly extending sections integral with said ring, said rotor contact being positioned to be in electrical contact with said radially inwardly-extending projections.

20. The structure of claim 19 further characterized by and including a second annular ring connecting all of said radially inwardly-extending matrix sections, said second ring being removable during assembly of said switch.

* * * * *